US005482287A

United States Patent [19]

Nesbitt et al.

[11] Patent Number: 5,482,287

[45] Date of Patent: Jan. 9, 1996

[54] GOLF BALL

[75] Inventors: R. Dennis Nesbitt, Westfield; Joseph F. Stiefel, Shrewsbury, both of Mass.; Terence Melvin, Somers, Conn.

[73] Assignee: Lisco, Inc., Tampa, Fla.

[21] Appl. No.: 368,195

[22] Filed: Jan. 4, 1995

[51] Int. Cl.[6] ..... A63B 37/14

[52] U.S. Cl. ..... 273/232

[58] Field of Search ..... 273/232

[56] References Cited

U.S. PATENT DOCUMENTS

| | | | |
|---|---|---|---|
| 5,009,427 | 4/1991 | Stiefel et al. | 273/232 |
| 5,018,741 | 5/1991 | Stiefel et al. | 273/232 |
| 5,273,287 | 12/1993 | Molitor et al. | 273/232 |

FOREIGN PATENT DOCUMENTS

| | | | |
|---|---|---|---|
| 377354 | 5/1931 | United Kingdom | 273/232 |

*Primary Examiner*—George J. Marlo
*Attorney, Agent, or Firm*—Donald R. Bahr; John E. Benoit

[57] ABSTRACT

A dimple configuration for a golf ball having a dimple-free equator wherein each hemisphere has substantially the same dimple pattern, the dimple pattern in each hemisphere comprising a total of 201 dimples with a dimple located at the pole and a first set of five adjacent triangles, with one vertex of each triangle being at the pole dimple and the sides of the triangles opposite the pole being spaced a predetermined distance from the equator. The pattern further comprises a second set of five triangles smaller than the first set of triangles and equally spaced between the first set of triangles and the equator. Each of the second set of triangles has a vertex common with adjacent ones of the first set of triangles. The legs of all the triangles contain adjacent dimples and the area within the large triangles and between the small triangles is also filled with dimples. Three different diameters of dimples are used within the pattern.

10 Claims, 3 Drawing Sheets

GOLF BALL

This invention relates generally to golf balls and more particularly to a specific arrangement of the dimples on a golf ball.

BACKGROUND OF THE INVENTION

It is generally known that for any given selected number of dimples on a golf ball, it is desirable that the area of the surface of the golf ball covered by the dimples be a maximum in order to provide the best flight characteristics for a golf ball. In British Patent Provisional Specification Serial No. 377,354, filed May 22, 1931, in the name of John Vernon Pugh, there is disclosed the fact that by the use of an icosahedral lattice for defining dimple patterns on a golf ball it is possible to make a geometrically symmetrical ball. This icosahedral lattice is developed by the known division of a sphere or spherical surface into like areas determined by an inscribed regular polyhedron such as an icosahedron. The Pugh specification specifically details the means of plotting the icosahedron on the surface of the golf ball and, accordingly, will not be dealt with in detail here. Thus, with a selected number and size of dimples placed in this icosahedral pattern, the area of the surface of the ball covered by the dimples is fixed.

A problem arises with the Pugh icosahedron golf ball in that there is no equatorial line on the ball which does not pass through some of the dimples on the ball. Since golf balls are molded and manufactured by using two hemispherical half molds normally having straight edges, the ball as it comes from the mold has a flash line about the equatorial line created by the two hemispheres of the mold. Such molding results in a clear flash line. Even if the ball could be molded with dimples on the flash line, the ball could not be properly cleaned and finished in any efficient manner since the flash could not be cleaned from the bottom of the dimple without individual treatment of each dimple.

The Pugh ball is geometrically symmetrical. Any changes in dimple location which affect the aerodynamic symmetry under U.S.G.A. standards will render the ball illegal for sanctioned play. Many proposals have been made and balls have been constructed with a modification of the Pugh icosahedral pattern so as to provide an equatorial line which is free of dimples. Again, it is emphasized that any such modification must be aerodynamically symmetrical.

Other dimple patterns have been proposed which use various geometrical arrangements. U.S. Pat. No. 4,932,644 to Pocklington et al discloses a golf ball having a dimple configuration arranged in these different patterns comprising a pentagon at each pole, five trapezoid formations in each hemisphere, and five triangular formations in each hemisphere.

U.S. Pat. No. 5,018,741 to Stiefel et al discloses a modified icosahedral dimple pattern having a total of 422 dimples using dimples having three different diameters.

U.S. Pat. No. 5,009,427 to Stiefel et al discloses a dimple pattern using a first set of five triangles and a second set of five triangles using dimples having two different diameters, the pattern having 402 dimples. The present invention is a modification of that dimple pattern using three different dimple diameters for providing different flight and distance parameters.

U.S.G.A. rules of golf require that the ball shall be designed and manufactured to perform in general as if it were aerodynamically symmetrical. A golf ball which is dimpled in some manner may be geometrically symmetrical and not aerodynamically symmetrical. A perfect example of a golf ball which is both geometrically symmetrical and aerodynamically symmetrical is a smooth sphere. As is well known, this ball is not capable of providing the necessary performance required in present-day golf. To conform, all balls must be aerodynamically symmetrical. This symmetry is determined by actual tests of the ball as it is being struck by a machine which belongs to the U.S.G.A.

It has been found that it is desirable to cover as much of the surface as possible with the dimples. While a great deal of the surface may be covered by making the dimples quite small, it has been found that this imparts some undesirable characteristics to the ball. At the same time, when larger diameter dimples are used and all the dimples are the same size, they should be arranged so as to cover the maximum surface area of the ball.

Accordingly, it is an object of the present invention to provide a dimpled golf ball having 402 dimples wherein a substantially maximum area of the surface is covered by dimples.

It is yet another object of the present invention to provide a dimpled golf ball wherein the dimples are formed in a pattern which includes a plurality of triangles.

These and other objects of the invention will become apparent from the following description taken together with the drawings.

SUMMARY OF THE INVENTION

The present invention provides a golf ball having 402 dimples formed on the spherical surface of the ball with the surface defining opposite poles and separated by a dimple-free equator midway between the poles so as to divide the surface into two hemispheres. Each of the hemispheres has substantially the same dimple pattern and each of the hemispheres has 201 dimples on its surface. Each dimple pattern in a hemisphere comprises a dimple located at the pole of the hemisphere and a first set of five substantially identical triangles, each of the triangles in the set having one vertex dimple located at the pole. Each of the legs of the triangles radiating outward from the pole dimple shares a common set of dimples. The leg opposite the polar dimple is substantially parallel to but spaced from the equator and includes a plurality of dimples. A second set of five triangles is provided between the first set of triangles and the equator. The triangles of the second set are equally spaced adjacent the equator and are smaller than the triangles in the first set. One vertex of each of the second set of triangles is common with the lower vertex of the adjacent triangle of the first set of triangles, with the leg opposite that vertex being parallel to but spaced from the equator. Dimples are located along each leg of the first and second sets of triangles, within the first set of triangles, and between the second set of triangles. The dimples have three different diameters within the dimple pattern.

DETAILED DESCRIPTION OF THE PREFERRED EMBODIMENT

Figure 1:
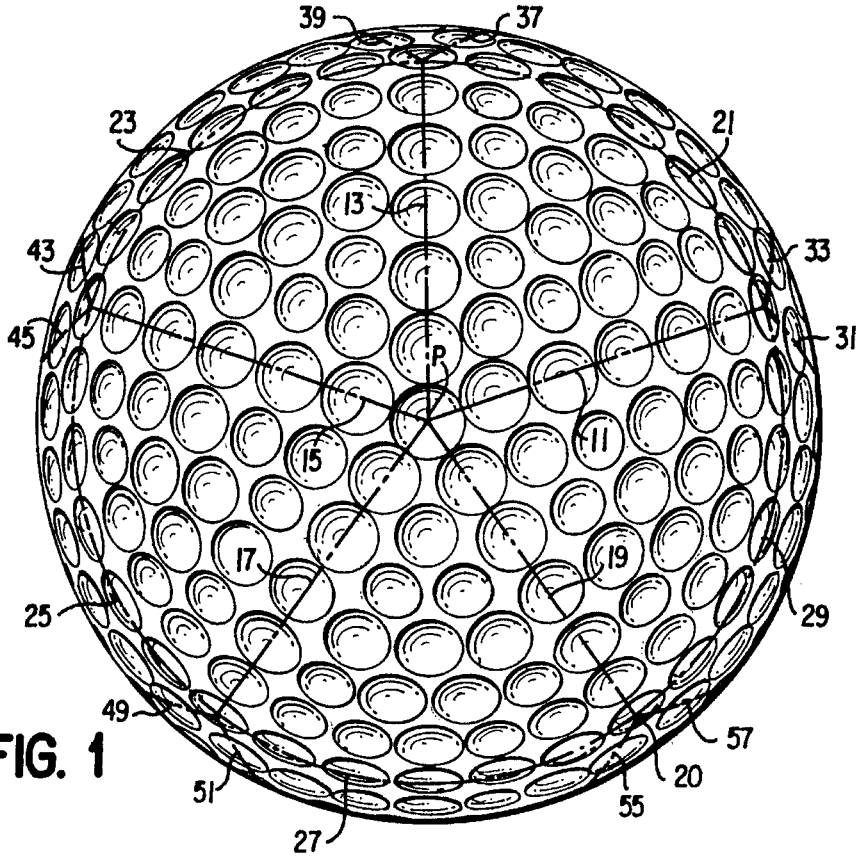
FIG. 1 is a top plan view of the ball of the present invention taken from one of the poles thereof.
Figure 2:
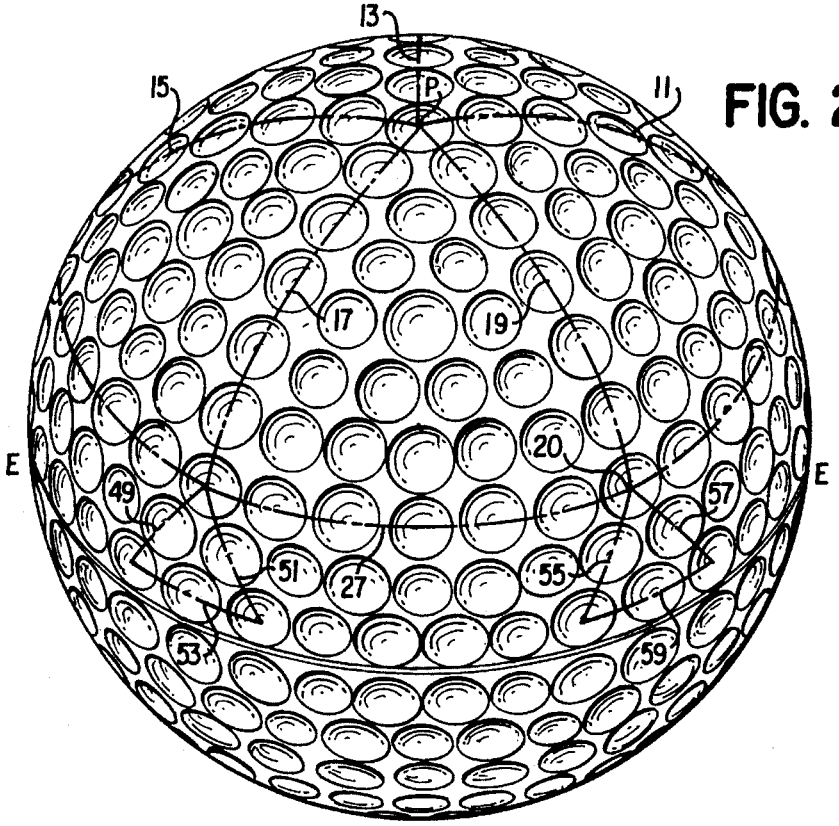
FIG. 2 is a plan view taken along an offset line from the equatorial line of the ball of FIG. 1.
Figure 3:
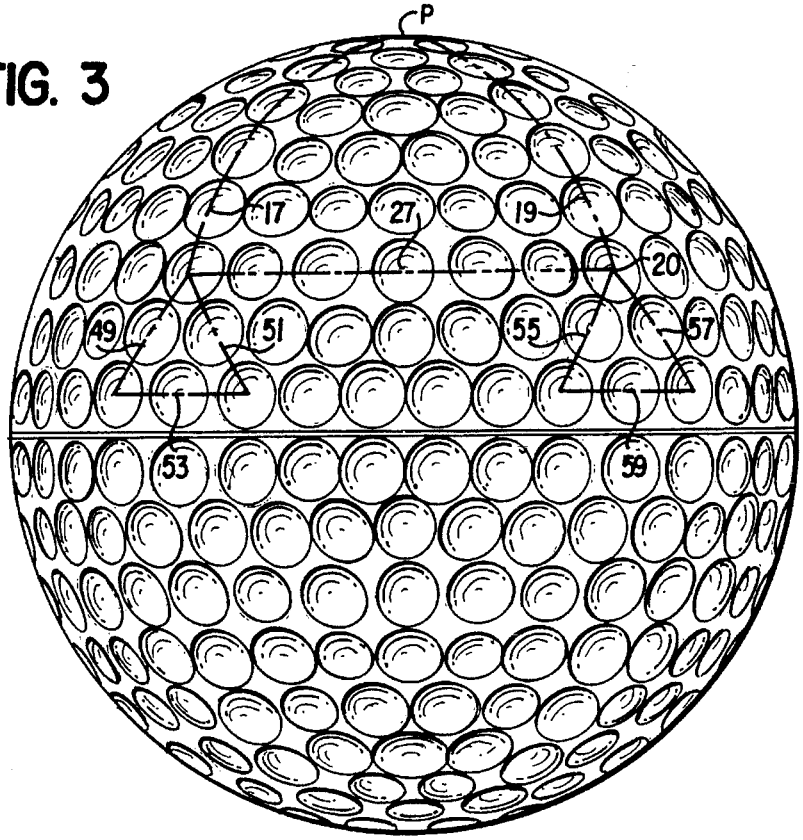
FIG. 3 is a plan view taken along the equatorial line of the ball of FIG. 1.

Referring to FIGS. 1–3, there is shown a golf ball which has two poles, one being clearly shown in FIG. 1. Equatorial line E-E effectively divides the ball into hemispheres. Each hemisphere has dimple patterns which are substantially equal, with the equator establishing a dimple-free line about the ball. Since each hemisphere has the same dimple pattern, only one hemisphere will be discussed.

A dimple is located at pole P and serves as one of the vertices of the five triangles which are formed by lines 11, 13, 15, 17 and 19 radiating outwardly to a point short of the equator. The triangles are completed by connecting the lower vertices of the lines with legs 21, 23, 25, 27 and 29. A plurality of dimples are located on each line and extend between the vertices created by the triangles. As will be obvious, a plurality of dimples are used to fill in the interior of the triangles. The specifics of the dimples for each triangle will be discussed as the description proceeds.

As shown in FIGS. 1, 2 and 3, a second set of five triangles smaller than the first set of triangles are equally spaced about the hemisphere between the lower legs of the first set of five triangles and the equator. The small triangles and the large triangles share a common vertex such as 20. Each triangle includes dimples arranged along the legs of the triangle. Leg 53 opposite the common vertex is substantially parallel but spaced from the equator, as are all of the equivalent legs. As previously noted, the dimples are arranged so that equator E-E remains dimple-free. Two of the triangles are clearly illustrated in FIG. 3 with each triangle including legs 49, 51 and 53 and legs 55, 57 and 59, respectively.

The area between the equator and the first set of triangles, and between all of the smaller triangles in the second set, is also filled in with dimples. As can be seen, the lowest set of dimples is substantially parallel to the equator, but still leaves the equatorial line dimple-free.

Figure 4:
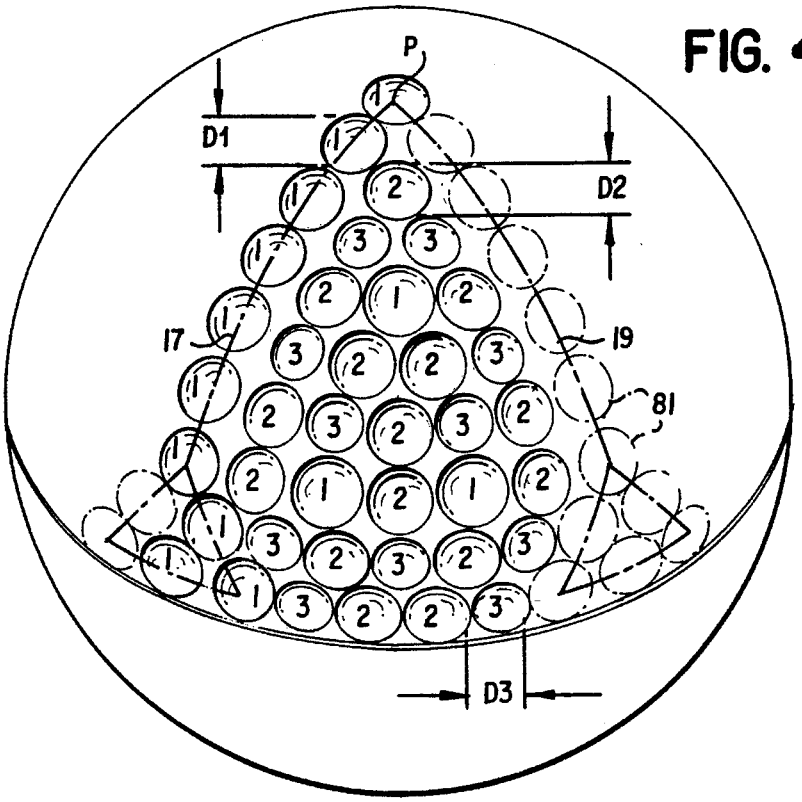
FIG. 4 is a plan view taken along an offset line from the equatorial line showing one set of dimples which is repeated in each hemisphere to establish the final dimple pattern.

FIG. 4 illustrates one set of the dimples which is repeated five times so as to form the final dimple pattern in each hemisphere. It should be noted that each of the five triangles shares common dimples. In order to relate the set of dimples shown in solid lines in the illustration of FIGS. 1–3, some of the dimples in adjacent sets are shown in phantom.

In the preferred embodiment, as illustrated in the drawings, dimples with three different diameters are used and are indicated as D1, D2, and D3. Further, the relationship of the dimples is D1>D2>D3. In order to maintain clarity of the drawings, the sizes of the dimples are merely indicated by the numerals 1, 2, and 3, which relate directly to D1, D2, and D3.

As will be evident, dimples having a diameter D1 lie along the lines which radiate from the pole dimple and form two sides of each of the larger triangles. The dimples lying along the leg opposite the pole dimple alternate between dimple sizes D1 and D2.

The dimples which lie along the legs of the smaller triangles include six dimples, one of which is common with the vertex dimple of the larger triangles. All these dimples have a diameter D1.

The space within the larger triangles is filled with dimples having diameters D1, D2, and D3, while the area between the spaced smaller triangles includes dimples having diameters D2 and D3.

Each of the sections shown in solid lines in FIG. 4 contains 14 dimples having a diameter D1, 15 dimples having a diameter D2, and 11 dimples having a diameter D3, besides the pole dimple, which has a diameter D1. Thus, the number of dimples per hemisphere, including the pole dimple, is 201, resulting in a ball having a total of 402 dimples.

With one embodiment of the ball as shown being of a standard diameter and having 402 dimples with three different diameters, and the two hemispheres being substantially identical, there follows the physical coordinates and diameters of each of the dimples in one hemisphere:

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 1 | 0 | 0 | 0 | 0 | 0 | 0 | 0.152 |
| 2 | 10 | 34 | 0 | 0 | 0 | 0 | 0.152 |
| 3 | 10 | 34 | 0 | 72 | 0 | 0 | 0.152 |
| 4 | 10 | 34 | 0 | 144 | 0 | 0 | 0.152 |
| 5 | 10 | 34 | 0 | 216 | 0 | 0 | 0.152 |
| 6 | 10 | 34 | 0 | 288 | 0 | 0 | 0.152 |
| 7 | 17 | 28 | 15 | 36 | 0 | 0 | 0.140 |
| 8 | 17 | 28 | 15 | 108 | 0 | 0 | 0.140 |
| 9 | 17 | 28 | 15 | 180 | 0 | 0 | 0.140 |
| 10 | 17 | 28 | 15 | 252 | 0 | 0 | 0.140 |
| 11 | 17 | 28 | 15 | 324 | 0 | 0 | 0.140 |
| 12 | 21 | 30 | 0 | 0 | 0 | 0 | 0.152 |
| 13 | 21 | 30 | 0 | 72 | 0 | 0 | 0.152 |
| 14 | 21 | 30 | 0 | 144 | 0 | 0 | 0.152 |
| 15 | 21 | 30 | 0 | 216 | 0 | 0 | 0.152 |
| 16 | 21 | 30 | 0 | 288 | 0 | 0 | 0.152 |
| 17 | 26 | 25 | 45 | 24 | 18 | 15 | 0.131 |
| 18 | 26 | 25 | 45 | 47 | 41 | 45 | 0.131 |
| 19 | 26 | 25 | 45 | 96 | 18 | 15 | 0.131 |
| 20 | 26 | 25 | 45 | 119 | 41 | 45 | 0.131 |
| 21 | 26 | 25 | 45 | 168 | 18 | 15 | 0.131 |
| 22 | 26 | 25 | 45 | 191 | 41 | 45 | 0.131 |
| 23 | 26 | 25 | 45 | 240 | 18 | 15 | 0.131 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 24 | 26 | 25 | 45 | 263 | 41 | 45 | 0.131 |
| 25 | 26 | 25 | 45 | 312 | 18 | 15 | 0.131 |
| 26 | 26 | 25 | 45 | 335 | 41 | 45 | 0.131 |
| 27 | 32 | 27 | 0 | 0 | 0 | 0 | 0.152 |
| 28 | 32 | 27 | 0 | 72 | 0 | 0 | 0.152 |
| 29 | 32 | 27 | 0 | 144 | 0 | 0 | 0.152 |
| 30 | 32 | 27 | 0 | 216 | 0 | 0 | 0.152 |
| 31 | 32 | 27 | 0 | 288 | 0 | 0 | 0.152 |
| 32 | 35 | 24 | 45 | 36 | 0 | 0 | 0.152 |
| 33 | 35 | 24 | 45 | 108 | 0 | 0 | 0.152 |
| 34 | 35 | 24 | 45 | 180 | 0 | 0 | 0.152 |
| 35 | 35 | 24 | 45 | 252 | 0 | 0 | 0.152 |
| 36 | 35 | 24 | 45 | 324 | 0 | 0 | 0.152 |
| 37 | 35 | 44 | 30 | 18 | 3 | 45 | 0.140 |
| 38 | 35 | 44 | 30 | 53 | 56 | 15 | 0.140 |
| 39 | 35 | 44 | 30 | 90 | 3 | 45 | 0.140 |
| 40 | 35 | 44 | 30 | 125 | 56 | 15 | 0.140 |
| 41 | 35 | 44 | 30 | 162 | 3 | 45 | 0.140 |
| 42 | 35 | 44 | 30 | 197 | 56 | 15 | 0.140 |
| 43 | 35 | 44 | 30 | 234 | 3 | 45 | 0.140 |
| 44 | 35 | 44 | 30 | 269 | 56 | 15 | 0.140 |
| 45 | 35 | 44 | 30 | 306 | 3 | 45 | 0.140 |
| 46 | 35 | 44 | 30 | 341 | 56 | 15 | 0.140 |
| 47 | 43 | 44 | 0 | 0 | 0 | 0 | 0.152 |
| 48 | 43 | 44 | 0 | 72 | 0 | 0 | 0.152 |
| 49 | 43 | 44 | 0 | 144 | 0 | 0 | 0.152 |
| 50 | 43 | 44 | 0 | 216 | 0 | 0 | 0.152 |
| 51 | 43 | 44 | 0 | 288 | 0 | 0 | 0.152 |
| 52 | 45 | 26 | 30 | 14 | 40 | 45 | 0.131 |
| 53 | 45 | 26 | 30 | 57 | 19 | 15 | 0.131 |
| 54 | 45 | 26 | 30 | 86 | 40 | 45 | 0.131 |
| 55 | 45 | 26 | 30 | 129 | 19 | 15 | 0.131 |
| 56 | 45 | 26 | 30 | 158 | 40 | 45 | 0.131 |
| 57 | 45 | 26 | 30 | 201 | 19 | 15 | 0.131 |
| 58 | 45 | 26 | 30 | 230 | 40 | 45 | 0.131 |
| 59 | 45 | 26 | 30 | 273 | 19 | 15 | 0.131 |
| 60 | 45 | 26 | 30 | 302 | 40 | 45 | 0.131 |
| 61 | 45 | 26 | 30 | 345 | 19 | 15 | 0.131 |
| 62 | 45 | 26 | 45 | 28 | 52 | 0 | 0.140 |
| 63 | 45 | 26 | 45 | 43 | 8 | 0 | 0.140 |
| 64 | 45 | 26 | 45 | 100 | 52 | 0 | 0.140 |
| 65 | 45 | 26 | 45 | 115 | 8 | 0 | 0.140 |
| 66 | 45 | 26 | 45 | 172 | 52 | 0 | 0.140 |
| 67 | 45 | 26 | 45 | 187 | 8 | 0 | 0.140 |
| 68 | 45 | 26 | 45 | 244 | 52 | 0 | 0.140 |
| 69 | 45 | 26 | 45 | 259 | 8 | 0 | 0.140 |
| 70 | 45 | 26 | 45 | 316 | 52 | 0 | 0.140 |
| 71 | 45 | 26 | 45 | 331 | 8 | 0 | 0.140 |
| 72 | 54 | 57 | 0 | 0 | 0 | 0 | 0.152 |
| 73 | 54 | 57 | 0 | 72 | 0 | 0 | 0.152 |
| 74 | 54 | 57 | 0 | 144 | 0 | 0 | 0.152 |
| 75 | 54 | 57 | 0 | 216 | 0 | 0 | 0.152 |
| 76 | 54 | 57 | 0 | 288 | 0 | 0 | 0.152 |
| 77 | 54 | 57 | 30 | 24 | 30 | 15 | 0.131 |
| 78 | 54 | 57 | 30 | 47 | 29 | 45 | 0.131 |
| 79 | 54 | 57 | 30 | 96 | 30 | 15 | 0.131 |
| 80 | 54 | 57 | 30 | 119 | 29 | 45 | 0.131 |
| 81 | 54 | 57 | 30 | 168 | 30 | 15 | 0.131 |
| 82 | 54 | 57 | 30 | 191 | 29 | 45 | 0.131 |
| 83 | 54 | 57 | 30 | 240 | 30 | 15 | 0.131 |
| 84 | 54 | 57 | 30 | 263 | 29 | 45 | 0.131 |
| 85 | 54 | 57 | 30 | 312 | 30 | 15 | 0.131 |
| 86 | 54 | 57 | 30 | 335 | 29 | 45 | 0.131 |
| 87 | 55 | 19 | 30 | 12 | 43 | 15 | 0.140 |
| 88 | 55 | 19 | 30 | 59 | 17 | 0 | 0.140 |
| 89 | 55 | 19 | 30 | 84 | 43 | 15 | 0.140 |
| 90 | 55 | 19 | 30 | 131 | 17 | 0 | 0.140 |
| 91 | 55 | 19 | 30 | 156 | 43 | 15 | 0.140 |
| 92 | 55 | 19 | 30 | 203 | 17 | 0 | 0.140 |
| 93 | 55 | 19 | 30 | 228 | 43 | 15 | 0.140 |
| 94 | 55 | 19 | 30 | 275 | 17 | 0 | 0.140 |
| 95 | 55 | 19 | 30 | 300 | 43 | 15 | 0.140 |
| 96 | 55 | 19 | 30 | 347 | 17 | 0 | 0.140 |
| 97 | 55 | 30 | 15 | 36 | 0 | 0 | 0.140 |
| 98 | 55 | 30 | 15 | 108 | 0 | 0 | 0.140 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 99 | 55 | 30 | 15 | 180 | 0 | 0 | 0.140 |
| 100 | 55 | 30 | 15 | 252 | 0 | 0 | 0.140 |
| 101 | 55 | 30 | 15 | 324 | 0 | 0 | 0.140 |
| 102 | 65 | 6 | 30 | 24 | 1 | 15 | 0.152 |
| 103 | 65 | 6 | 30 | 47 | 58 | 45 | 0.152 |
| 104 | 65 | 6 | 30 | 96 | 1 | 15 | 0.152 |
| 105 | 65 | 6 | 30 | 119 | 58 | 45 | 0.152 |
| 106 | 65 | 6 | 30 | 168 | 1 | 15 | 0.152 |
| 107 | 65 | 6 | 30 | 191 | 58 | 45 | 0.152 |
| 108 | 65 | 6 | 30 | 240 | 1 | 15 | 0.152 |
| 109 | 65 | 6 | 30 | 263 | 58 | 45 | 0.152 |
| 110 | 65 | 6 | 30 | 312 | 1 | 15 | 0.152 |
| 111 | 65 | 6 | 30 | 335 | 58 | 45 | 0.152 |
| 112 | 65 | 36 | 30 | 36 | 0 | 0 | 0.140 |
| 113 | 65 | 36 | 30 | 108 | 0 | 0 | 0.140 |
| 114 | 65 | 36 | 30 | 180 | 0 | 0 | 0.140 |
| 115 | 65 | 36 | 30 | 252 | 0 | 0 | 0.140 |
| 116 | 65 | 36 | 30 | 324 | 0 | 0 | 0.140 |
| 117 | 65 | 37 | 15 | 11 | 59 | 30 | 0.140 |
| 118 | 65 | 37 | 15 | 60 | 0 | 30 | 0.140 |
| 119 | 65 | 37 | 15 | 83 | 59 | 30 | 0.140 |
| 120 | 65 | 37 | 15 | 132 | 0 | 30 | 0.140 |
| 121 | 65 | 37 | 15 | 155 | 59 | 30 | 0.140 |
| 122 | 65 | 37 | 15 | 204 | 0 | 30 | 0.140 |
| 123 | 65 | 37 | 15 | 227 | 59 | 30 | 0.140 |
| 124 | 65 | 37 | 15 | 276 | 0 | 30 | 0.140 |
| 125 | 65 | 37 | 15 | 299 | 59 | 30 | 0.140 |
| 126 | 65 | 37 | 15 | 348 | 0 | 30 | 0.140 |
| 127 | 66 | 13 | 0 | 0 | 0 | 0 | 0.152 |
| 128 | 66 | 13 | 0 | 72 | 0 | 0 | 0.152 |
| 129 | 66 | 13 | 0 | 144 | 0 | 0 | 0.152 |
| 130 | 66 | 13 | 0 | 216 | 0 | 0 | 0.152 |
| 131 | 66 | 13 | 0 | 288 | 0 | 0 | 0.152 |
| 132 | 74 | 38 | 15 | 16 | 19 | 30 | 0.131 |
| 133 | 74 | 38 | 15 | 55 | 40 | 30 | 0.131 |
| 134 | 74 | 38 | 15 | 88 | 19 | 30 | 0.131 |
| 135 | 74 | 38 | 15 | 127 | 40 | 30 | 0.131 |
| 136 | 74 | 38 | 15 | 160 | 19 | 30 | 0.131 |
| 137 | 74 | 38 | 15 | 199 | 40 | 30 | 0.131 |
| 138 | 74 | 38 | 15 | 232 | 19 | 30 | 0.131 |
| 139 | 74 | 38 | 15 | 271 | 40 | 30 | 0.131 |
| 140 | 74 | 38 | 15 | 304 | 19 | 30 | 0.131 |
| 141 | 74 | 38 | 15 | 343 | 40 | 30 | 0.131 |
| 142 | 75 | 7 | 0 | 6 | 0 | 0 | 0.152 |
| 143 | 75 | 7 | 0 | 66 | 0 | 0 | 0.152 |
| 144 | 75 | 7 | 0 | 78 | 0 | 0 | 0.152 |
| 145 | 75 | 7 | 0 | 138 | 0 | 0 | 0.152 |
| 146 | 75 | 7 | 0 | 150 | 0 | 0 | 0.152 |
| 147 | 75 | 7 | 0 | 210 | 0 | 0 | 0.152 |
| 148 | 75 | 7 | 0 | 222 | 0 | 0 | 0.152 |
| 149 | 75 | 7 | 0 | 282 | 0 | 0 | 0.152 |
| 150 | 75 | 7 | 0 | 294 | 0 | 0 | 0.152 |
| 151 | 75 | 7 | 0 | 354 | 0 | 0 | 0.152 |
| 152 | 75 | 19 | 45 | 26 | 12 | 15 | 0.140 |
| 153 | 75 | 19 | 45 | 45 | 47 | 45 | 0.140 |
| 154 | 75 | 19 | 45 | 98 | 12 | 15 | 0.140 |
| 155 | 75 | 19 | 45 | 117 | 47 | 45 | 0.140 |
| 156 | 75 | 19 | 45 | 170 | 12 | 15 | 0.140 |
| 157 | 75 | 19 | 45 | 189 | 47 | 45 | 0.140 |
| 158 | 75 | 19 | 45 | 242 | 12 | 15 | 0.140 |
| 159 | 75 | 19 | 45 | 261 | 47 | 45 | 0.140 |
| 160 | 75 | 19 | 45 | 314 | 12 | 15 | 0.140 |
| 161 | 75 | 19 | 45 | 333 | 47 | 45 | 0.140 |
| 162 | 75 | 39 | 15 | 36 | 0 | 0 | 0.131 |
| 163 | 75 | 39 | 15 | 108 | 0 | 0 | 0.131 |
| 164 | 75 | 39 | 15 | 180 | 0 | 0 | 0.131 |
| 165 | 75 | 39 | 15 | 252 | 0 | 0 | 0.131 |
| 166 | 75 | 39 | 15 | 324 | 0 | 0 | 0.131 |
| 167 | 84 | 16 | 0 | 0 | 0 | 0 | 0.152 |
| 168 | 84 | 16 | 0 | 12 | 0 | 0 | 0.152 |
| 169 | 84 | 16 | 0 | 60 | 0 | 0 | 0.152 |
| 170 | 84 | 16 | 0 | 72 | 0 | 0 | 0.152 |
| 171 | 84 | 16 | 0 | 84 | 0 | 0 | 0.152 |
| 172 | 84 | 16 | 0 | 132 | 0 | 0 | 0.152 |
| 173 | 84 | 16 | 0 | 144 | 0 | 0 | 0.152 |

-continued

| DIMPLE | LATITUDE | | | LONGITUDE | | | DIMPLE |
|---|---|---|---|---|---|---|---|
| NUMBER | Degrees | Minutes | Seconds | Degrees | Minutes | Seconds | DIAMETER |
| 174 | 84 | 16 | 0 | 156 | 0 | 0 | 0.152 |
| 175 | 84 | 16 | 0 | 204 | 0 | 0 | 0.152 |
| 176 | 84 | 16 | 0 | 216 | 0 | 0 | 0.152 |
| 177 | 84 | 16 | 0 | 228 | 0 | 0 | 0.152 |
| 178 | 84 | 16 | 0 | 276 | 0 | 0 | 0.152 |
| 179 | 84 | 16 | 0 | 288 | 0 | 0 | 0.152 |
| 180 | 84 | 16 | 0 | 300 | 0 | 0 | 0.152 |
| 181 | 84 | 16 | 0 | 348 | 0 | 0 | 0.152 |
| 182 | 84 | 22 | 15 | 21 | 49 | 15 | 0.131 |
| 183 | 84 | 22 | 15 | 31 | 10 | 45 | 0.140 |
| 184 | 84 | 22 | 15 | 40 | 49 | 15 | 0.140 |
| 185 | 84 | 22 | 15 | 50 | 10 | 45 | 0.131 |
| 186 | 84 | 22 | 15 | 93 | 49 | 15 | 0.131 |
| 187 | 84 | 22 | 15 | 103 | 10 | 45 | 0.140 |
| 188 | 84 | 22 | 15 | 112 | 49 | 15 | 0.140 |
| 189 | 84 | 22 | 15 | 122 | 10 | 45 | 0.131 |
| 190 | 84 | 22 | 15 | 165 | 49 | 15 | 0.131 |
| 191 | 84 | 22 | 15 | 175 | 10 | 45 | 0.140 |
| 192 | 84 | 22 | 15 | 184 | 49 | 15 | 0.140 |
| 193 | 84 | 22 | 15 | 194 | 10 | 45 | 0.131 |
| 194 | 84 | 22 | 15 | 237 | 49 | 15 | 0.131 |
| 195 | 84 | 22 | 15 | 247 | 10 | 45 | 0.140 |
| 196 | 84 | 22 | 15 | 256 | 49 | 15 | 0.140 |
| 197 | 84 | 22 | 15 | 266 | 10 | 45 | 0.131 |
| 198 | 84 | 22 | 15 | 309 | 49 | 15 | 0.131 |
| 199 | 84 | 22 | 15 | 319 | 10 | 45 | 0.140 |
| 200 | 84 | 22 | 15 | 328 | 49 | 15 | 0.140 |
| 201 | 84 | 22 | 15 | 338 | 10 | 45 | 0.131 |

As indicated, in this embodiment D1 is 0.152 inch, D2 is 0.140 inch, and D3 is 0.131 inch.

For modern golf balls it is preferable that the dimple coverage be at least 70% of the surface area. The specific example shown and discussed has a dimple coverage of 71.65% of the surface of the ball.

Figure 5:
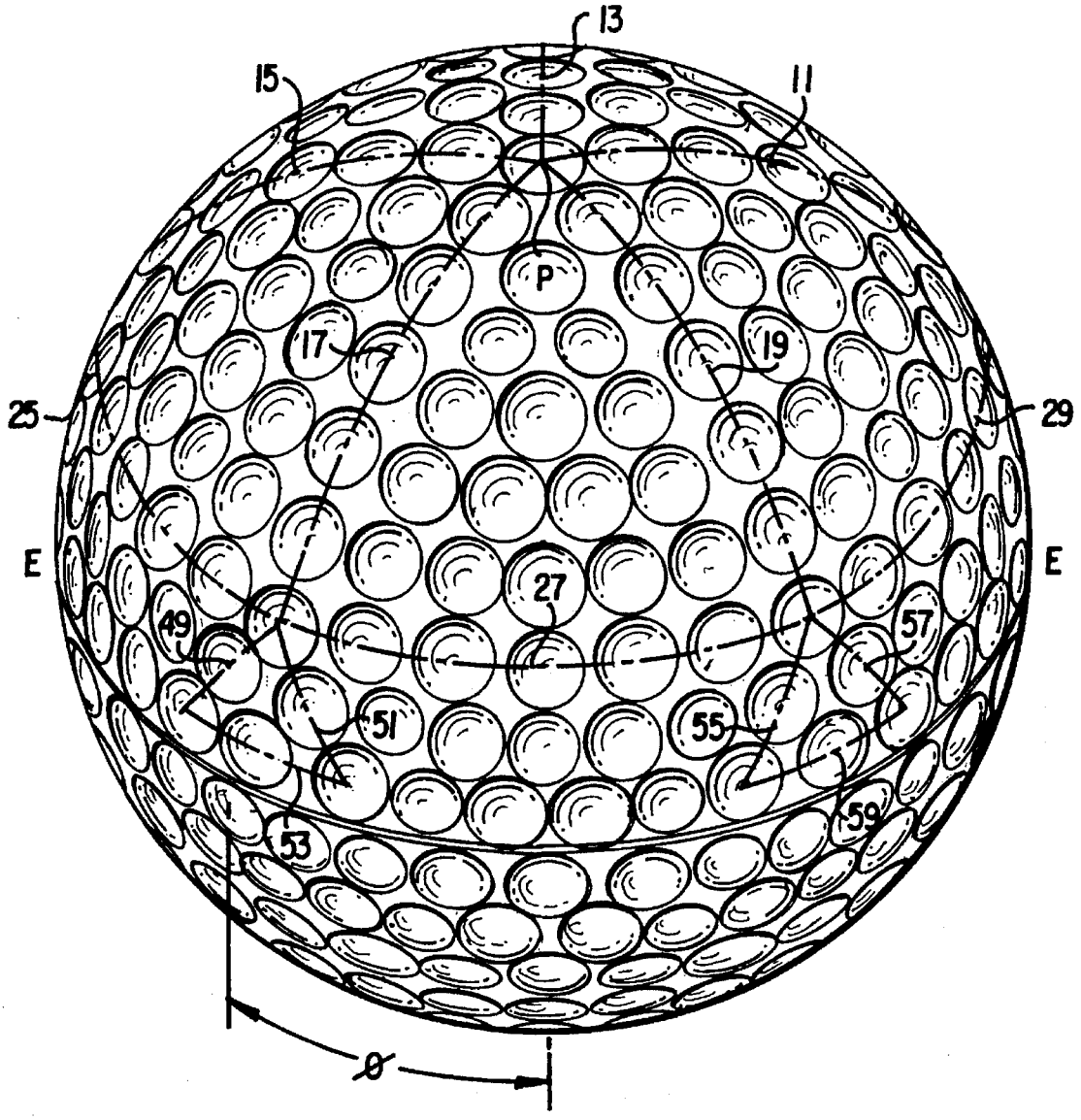
FIG. 5 is a plan view taken along an offset line from the equatorial line of a modification of the ball of FIGS. 1–4.

While the dimple patterns are substantially identical in each hemisphere and are shown in line in FIGS. 1–3, the two hemispheres may be rotated relative to each other so as to provide an offset of the hemispheres at the equator. This may be desirable for enhancing aerodynamic stability. In the embodiment shown in FIG. 5 of the drawings, the hemispheres have been rotated relative to each other through arc $\phi$. In the particular illustration of FIG. 5, this arc is 36°.

It is to be understood that the description and drawings are illustrative only since the scope of the invention is to be limited only by the following claims.

We claim:

1. A golf ball having 402 dimples formed on the spherical surface of the ball, said surface defining opposite poles and an equator midway between said poles dividing the surface into two hemispheres, each of said hemispheres having substantially the same dimple pattern, said dimple pattern comprising a dimple located at the pole of the hemisphere;

a first set of five substantially identical triangles, each of said triangles having one vertex located at said pole dimple, said triangles having legs which radiate outwardly from said pole dimple, each of said legs sharing a common set of dimples with the legs of the adjacent triangles, the leg opposite said pole dimple of each of said triangles having a plurality of dimples which are substantially parallel to but spaced from said equator;

a second set of five triangles, smaller than said first set of triangles, equally spaced between said first set of triangles and said equator;

one vertex of each of said second set of triangles being common with the lower vertex of the adjacent triangle of said first set of triangles, the leg opposite said one vertex of said second set of triangles being parallel to but spaced from said equator, all of the legs of said second set of triangles having dimples thereon; and dimples located within said first set of triangles and between said second set of triangles, said hemisphere having a total of 201 dimples;

said dimples including three different diameters, D1, D2, and D3, with the relative diameters being D1>D2>D3; and the dimples lying along said legs of said first set of triangles which radiate from said polar dimple and all of the legs of said second set of triangles are of a diameter D1.

2. The golf ball of claim 1 wherein said dimples between said second set of triangles comprises a first row of dimples substantially parallel with but spaced from said equator; and a second row of dimples substantially parallel to said first row between said first row and said legs of said first set of triangles opposite said polar dimple.

3. The golf ball of claim 2 wherein said first and second rows of dimples comprise dimples having a diameter of D2 and D3.

4. The golf ball of claim 2 wherein the dimples lying along said legs of said first set of triangles opposite said polar dimple comprise dimples having diameters of D1 and D2.

5. The golf ball of claim 2 wherein the dimples within said first set of five triangles comprise dimples having diameters of D1, D2, and D3.

6. The golf ball of claim 1 wherein said dimples cover at least 70% of the surface of said ball.

7. The golf ball of claim 1 wherein there are 142 dimples having a diameter D1, 150 dimples having a diameter D2, and 110 dimples having a diameter D3.

8. The golf ball of claim 7 wherein diameter D1 is substantially 0.152 inch, diameter D2 is substantially 0.140 inch, and diameter D3 is substantially 0.131 inch.

9. The golf ball of claim 1 wherein the two hemispheres are rotated relative to each other through an arc $\phi$ so as to provide a predetermined offset between said hemispheres.

10. The golf ball of claim 9 wherein said arc $\phi$ is substantially 36°.

* * * * *